US012129738B2

(12) United States Patent
Kharrat et al.

(10) Patent No.: US 12,129,738 B2
(45) Date of Patent: Oct. 29, 2024

(54) MULTICYCLE VALVE SYSTEM

(71) Applicant: Schlumberger Technology Corporation, Sugar Land, TX (US)

(72) Inventors: Houssem Kharrat, Houston, TX (US); Laurent Alteirac, Missouri city, TX (US); Robert M. Graham, Houston, TX (US); Chandy Benjamin, Missouri City, TX (US); Mohd Nazri Md Noor, Kuala Lumpur (MY)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/260,680

(22) PCT Filed: Jan. 10, 2022

(86) PCT No.: PCT/US2022/011775

§ 371 (c)(1),
(2) Date: Jul. 7, 2023

(87) PCT Pub. No.: WO2022/159295

PCT Pub. Date: Jul. 28, 2022

(65) Prior Publication Data

US 2024/0060394 A1 Feb. 22, 2024

Related U.S. Application Data

(60) Provisional application No. 63/139,541, filed on Jan. 20, 2021.

(51) Int. Cl.
*E21B 34/14* (2006.01)
*E21B 34/06* (2006.01)
(Continued)

(52) U.S. Cl.
CPC ..... *E21B 34/14* (2013.01); *E21B 34/063* (2013.01); *E21B 34/08* (2013.01); *E21B 34/12* (2013.01)

(58) Field of Classification Search
CPC ..... E21B 34/08; E21B 34/063; E21B 34/12; E21B 34/14
See application file for complete search history.

(56) References Cited

U.S. PATENT DOCUMENTS 8,757,265 B1 6/2014 Cuffe
9,133,689 B2 * 9/2015 George ..... E21B 34/142
(Continued)

FOREIGN PATENT DOCUMENTS

WO 2012112657 A2 8/2012

OTHER PUBLICATIONS

International Search Report and Written Opinion issued in the PCT Application PCT/US2022/011775, dated Sep. 7, 2022 (10 pages).

*Primary Examiner* — Yong-Suk (Philip) Ro
(74) *Attorney, Agent, or Firm* — Jeffrey D. Frantz

(57) ABSTRACT

A technique facilitates multiple actuations of a toe valve system positioned along a tubing string. According to an embodiment, the toe valve system comprises a piston sleeve slidably disposed in an outer housing which has at least one port therethrough. The toe valve system also may comprise a shifting sleeve shiftable between positions with respect to the at least one port. The piston sleeve may initially be held in a position closing off the at least one port to prevent flow between the interior and exterior of the tubing string. The piston sleeve is held in this closed position via a liquid trapped in a piston chamber which is located between the piston sleeve and the outer housing. The liquid, e.g. oil, is retained in the piston chamber by a release member, e.g. a rupture disc, until sufficient pressure is applied within the toe valve system and against the piston sleeve so as to actuate
(Continued)

the release member and to thus allow outflow of liquid from the piston chamber.

20 Claims, 4 Drawing Sheets

(51) Int. Cl.
*E21B 34/08* (2006.01)
*E21B 34/12* (2006.01)

(56) References Cited

U.S. PATENT DOCUMENTS

| | | | | |
|---|---|---|---|---|
| 11,773,690 | B2 * | 10/2023 | Patel | E21B 34/14<br>166/375 |
| 2014/0251619 | A1 | 9/2014 | George | |
| 2015/0315873 | A1 | 11/2015 | Mailand | |
| 2016/0215581 | A1 * | 7/2016 | Ingraham | E21B 34/14 |
| 2019/0136664 | A1 | 5/2019 | Roessler | |
| 2022/0364438 | A1 * | 11/2022 | Mackay | E21B 34/14 |

* cited by examiner

MULTICYCLE VALVE SYSTEM

CROSS-REFERENCE TO RELATED APPLICATIONS

The present application is a National Stage Entry of International Application No. PCT/US2022/011775, filed Jan. 10, 2022, claims priority benefit of U.S. Provisional Application No. 63/139,541, filed Jan. 20, 2021, the entirety of which is incorporated by reference herein and should be considered part of this specification.

BACKGROUND

In a variety of well applications, a toe valve may be positioned along a casing string to enable selective communication between a wellbore and the surrounding reservoir via circumferential flow ports. In a multistage stimulation, for example, a toe valve may be run at the toe of the casing in a closed position. The toe valve is then actuated to open the circumferential flow ports to provide communication between the interior of the casing and the surrounding reservoir. This allows an operator to run perforation guns, plugs, and other tools via wireline in a horizontal section of the wellbore by pumping fluids down through the casing string. The pumped fluids effectively push the tool or tools along the wellbore before exiting the casing through the flow ports of the toe valve. In some subsequent operations, such as sand control, there is a need to sequentially open and close the toe valve multiple times.

SUMMARY

In general, a system and methodology provide a multicycle valve system, e.g. a multicycle toe valve system, which may be positioned along a tubing string, e.g. a casing string, and actuated multiple times as desired. According to an embodiment, a multicycle toe valve system comprises a piston sleeve slidably disposed in an outer housing which has at least one port therethrough. The toe valve system also may comprise a shifting sleeve shiftable between positions with respect to the at least one port. The piston sleeve may initially be held in a position closing off the at least one port to prevent flow between the interior and exterior of the tubing string. The piston sleeve is held in this closed position via a liquid trapped in a piston chamber which is located between the piston sleeve and the outer housing to provide pressure balancing across the piston sleeve. The liquid, e.g. oil, is retained in the piston chamber by a release member, e.g. a rupture disc, until sufficient pressure is applied within the toe valve system and against the piston sleeve so as to actuate the release member and to thus allow outflow of liquid from the piston chamber. In at least some embodiments, the outflow of liquid is guided along passageways to an atmospheric chamber. Subsequently, the shifting sleeve may be actuated multiple times to close or open the at least one port.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
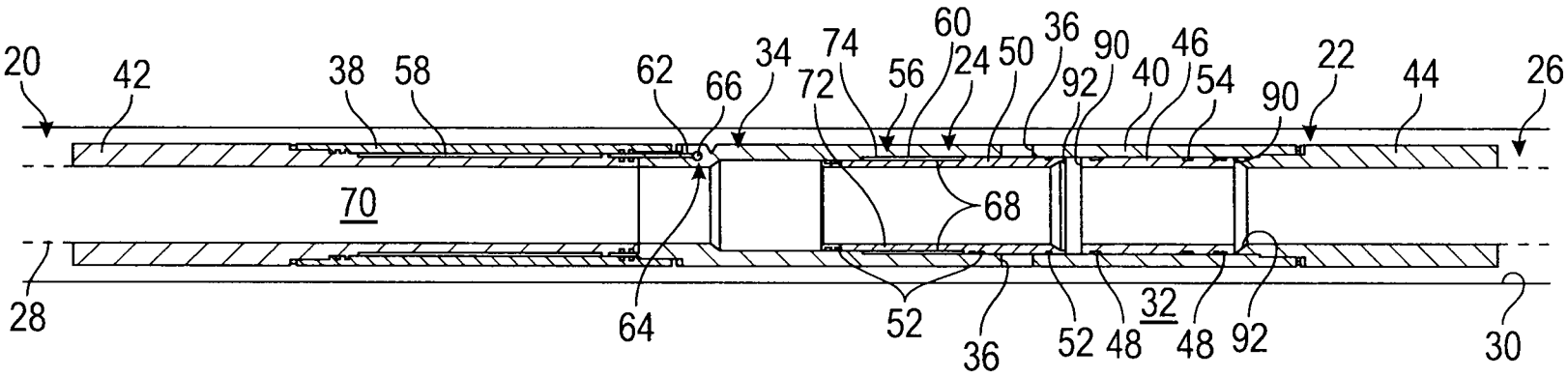
FIG. 1 is a cross-sectional illustration of an example of a multicycle valve system in the form of a toe valve system positioned along a tubing string and deployed in a borehole, e.g. a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology providing improved control of fluid flow between an interior and an exterior of a tubing string, e.g. improved communication between a wellbore and a surrounding reservoir. According to an embodiment, a multicycle valve system may be positioned along a casing string or other type of tubing string and may easily be actuated multiple times between closed flow and open flow positions. For purposes of explanation, the multicycle valve system is described in the form of a toe valve system positioned along the tubing string although the multicycle valve system may have other configurations and may be used in other types of operations. As described in greater detail below, a pressure increase along the interior of the tubing string may be used to initially activate the toe valve system and to open one or more flow ports, thus allowing radial flow between an interior and an exterior of the tubing string.

In a variety of operations, such as sand control operations where hydrocarbons are produced through sand control screens, the toe valve system is re-closed after the initial opening. Additionally, during various troubleshooting operations the toe valve system may be opened and closed multiple times. The technique described herein utilizes a pressure activated multicycle toe valve system. In various operations, the toe valve system is initially run downhole in a closed position, and then a first shift/actuation is performed via a pressure increase along the interior of the tubing string. Once the interior pressure is increased to a level above a predetermined value, a component is shifted to open the toe valve system. This actuation effectively enables fluid flow between an interior and an exterior of the toe valve system via the one or more toe valve ports. Multiple subsequent shifts between open and closed positions may be performed by shifting a separate component with an appropriate shifting tool, e.g. a coiled tubing deployed shifting tool.

The construction of the toe valve system facilitates operations in many types of environments, including high pressure, high temperature, and sour environments. According to an embodiment, the toe valve system comprises a piston sleeve slidably disposed in an outer housing which has at least one port therethrough. In a variety of applications, the at least one port will comprise a plurality of radially oriented ports arranged circumferentially about the outer housing. The toe valve system also may comprise a shifting sleeve shiftable between positions with respect to the at least one port. The shifting sleeve may be constructed with a variety of shifting profiles selected for engagement with a corresponding shifting tool which can be used to easily transition the shifting sleeve between open and closed positions which allow or block flow through the at least one port.

Depending on the parameters of a given operation, the piston sleeve may initially be held in a position closing off the at least one port and thus preventing flow between the interior and exterior of the tubing string. The piston sleeve is held in this closed position via a liquid trapped in a piston chamber which is located between the piston sleeve and the outer housing. The piston chamber is positioned such that increased or decreased pressure along the interior of the tubing string acts on the piston sleeve to provide a corresponding pressurization of the liquid trapped in the piston chamber. This effectively provides pressure balancing across the piston sleeve. As a result, at least portions of the piston sleeve may be made with a relatively thin wall because the pressure balancing prevents ballooning or other potential distortions of the piston sleeve.

Additionally, the liquid, e.g. oil, is retained in the piston chamber by a release member which may be selectively opened to enable flow of the liquid from the piston chamber. By way of example, the release member may be pressure actuated via pressure applied within the tubing string above a predetermined level. In various embodiments, the release member may be in the form of a rupture member, e.g. a rupture disc. When sufficient pressure is applied within the toe valve system and against the piston sleeve, the release member is actuated to an open position allowing outflow of liquid from the piston chamber. In at least some embodiments, the outflow of liquid is guided along a passageway to an atmospheric chamber and the release member is located along the passageway. A flow restrictor also may be positioned along the passageway to ensure a controlled flow rate once the release member, e.g. rupture disc, is opened to allow flow.

Referring generally to FIG. 1, an example of a well system 20 is illustrated as comprising a multicycle valve system 22. In this embodiment, the multicycle valve system 22 is described as a toe valve system having a toe valve 24 disposed along a tubing string 26. However, the valve system 22 may have other multicycle valve system configurations for use in other types of operations, tubing strings, and/or locations along the tubing string. In the illustrated example, the tubing string 26 is in the form of a casing string 28 which may be positioned within a borehole 30, e.g. a wellbore. The borehole 30 is drilled into a surrounding reservoir 32, and the toe valve system 22 controls fluid communication between the tubing string 26/borehole 30 and the surrounding reservoir 32. In other words, the toe valve system 22 may be operated to control fluid flow between an interior and an exterior of the tubing string 26 when the tubing string 26 is positioned within borehole 30. Depending on the parameters of specific operations, the size, components, and materials used in the construction of tubing string 26, as well as toe valve system 22, may be changed or adjusted.

In the illustrated embodiment, the toe valve system 22 comprises an outer housing 34 having at least one port 36 to enable fluid flow between an interior and an exterior of the tubing string 26. In some embodiments, the outer housing 34 may comprise a plurality of outer housings, such as an upper housing 38 coupled with a lower housing 40. In the example illustrated, the upper housing 38 also is connected, e.g. threadably connected, with an upper sub 42; and the lower housing 40 is connected, e.g. threadably connected, with a bottom sub 44. The upper sub 42 and bottom sub 44 may be used to connect the toe valve system 22 into the overall tubing string 26. Additionally, the at least one port 36 may comprise a plurality of ports 36 which allow fluid flow between the interior and exterior of the toe valve system 22 and thus between the interior and exterior of the overall tubing string 26. In some embodiments, the plurality of ports 36 may be oriented in a generally radial direction through the outer housing 34 and may be arranged along a circumference of the outer housing 34 (see FIG. 2).

The toe valve system 22 may further comprise a shifting sleeve 46 slidably mounted within the outer housing 34 for movement between positions opening and closing the port(s) 36. The shifting sleeve 46 may comprise a plurality of seals 48 located about its circumference and oriented to form a sealing engagement with an interior surface of the outer housing 34. Additionally, the toe valve system 22 may comprise a piston sleeve 50 slidably mounted within the outer housing 34 for movement between positions closing and opening the port(s) 36. The piston sleeve 50 also may comprise a plurality of seals 52 located about its circumference and oriented to form a sealing engagement with the interior surface of outer housing 34. In FIG. 1, the piston sleeve 50 is illustrated in a closed position in which the piston sleeve 50 is located so as to cover ports 36 with seals 52 located on both sides of ports 36, thus preventing flow therethrough.

As further illustrated in FIG. 1, the shifting sleeve 46 is positioned away from the ports 36 such that flow would be allowed through ports 36 once piston sleeve 50 is shifted to an open flow position. The shifting sleeve 46 may be securely held in this position until actuation is desired via a retaining mechanism 54, e.g. a retaining ring or a collet. Simultaneously, the piston sleeve 50 may initially be held in this closed position via a chamber system 56 having, for example, an atmospheric chamber 58 connected with a piston chamber 60 via at least one passageway 62 initially blocked by a release member 64. By way of example, the release member 64 may be in the form of a rupture member 66, e.g. a rupture disc.

The piston chamber 60 may be located between the piston sleeve 50 and the outer housing 34. For example, the piston chamber 60 may be an annular chamber disposed about the piston sleeve 50. Initially, piston chamber 60 is filled with a liquid 68, such as a suitable oil or other appropriate liquid, which is held in piston chamber 60 via release member 64. Increased or decreased pressure within an interior 70 of tubing string 26 acts on piston sleeve 50 and causes a corresponding increase or decrease in the pressure of liquid 68. As a result, a continual pressure balance is maintained between an interior and an exterior of the piston sleeve 50 while liquid 68 remains in piston chamber 60. Because of this pressure balance, piston sleeve 50 may be constructed with a thin walled section 72, relative to the remainder of the piston sleeve 50, adjacent the piston chamber 60. The continual pressure balance prevents any pressure differentials from ballooning or otherwise distorting the thin walled section 72 of piston sleeve 50. It also should be noted that the positioning of seals 52 as well as the gap between piston sleeve 50 and shifting sleeve 46 enable a certain amount of longitudinal movement of piston sleeve 50 without opening ports 36 or contacting shifting sleeve 46. As a result, the piston sleeve 50 is able to shift slightly due to pressure changes within interior 70 and/or temperature changes acting on liquid 68 without detrimental consequences.

Figure 2:
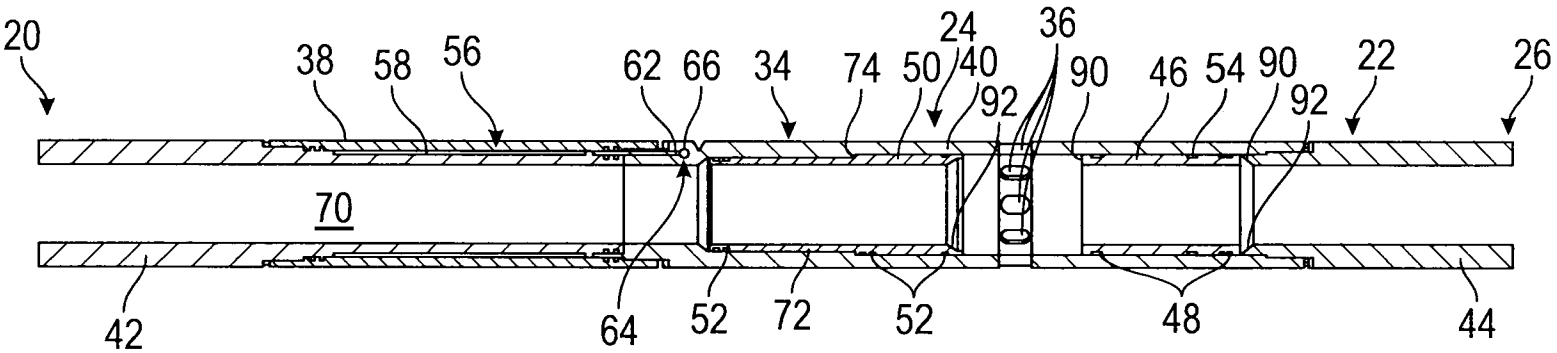
FIG. 2 is a cross-sectional illustration similar to that of FIG. 1 but showing the toe valve system in a different operational position, according to an embodiment of the disclosure.

However, once sufficient pressure is applied along interior 70 of tubing string 26 and against piston sleeve 50, the release member 64 is caused to open via the resulting increased pressure of liquid 68. For example, if release member 64 is in the form of a rupture disc 66 the interior pressure may be increased to a level sufficient to rupture the rupture disc 66. Following rupture or other type of release, the liquid 68 is able to flow along passageway 62 and to empty from piston chamber 60 as the increased pressure forces piston sleeve 50 to slide along the interior of the outer housing 34. The sliding piston sleeve 50 effectively forces liquid 68 from piston chamber 60, through passageway 62, and into atmospheric chamber 58. The piston sleeve 50 continues to move under pressure until it has shifted to an open position in which ports 36 are open to flow, as illustrated in FIG. 2. Shifting of the piston sleeve 50 may ultimately be limited via an abutment 74 or other suitable stop. It should be noted the atmospheric chamber 58 may initially be an empty chamber containing air or other suitable gas which is compressed or displaced as liquid 68 is forced into the atmospheric chamber 58. Depending on the parameters of a given application, the atmospheric chamber 58 may be constructed as an annular chamber and may be located between the upper housing 38 and upper sub 42 as illustrated.

Figure 3:
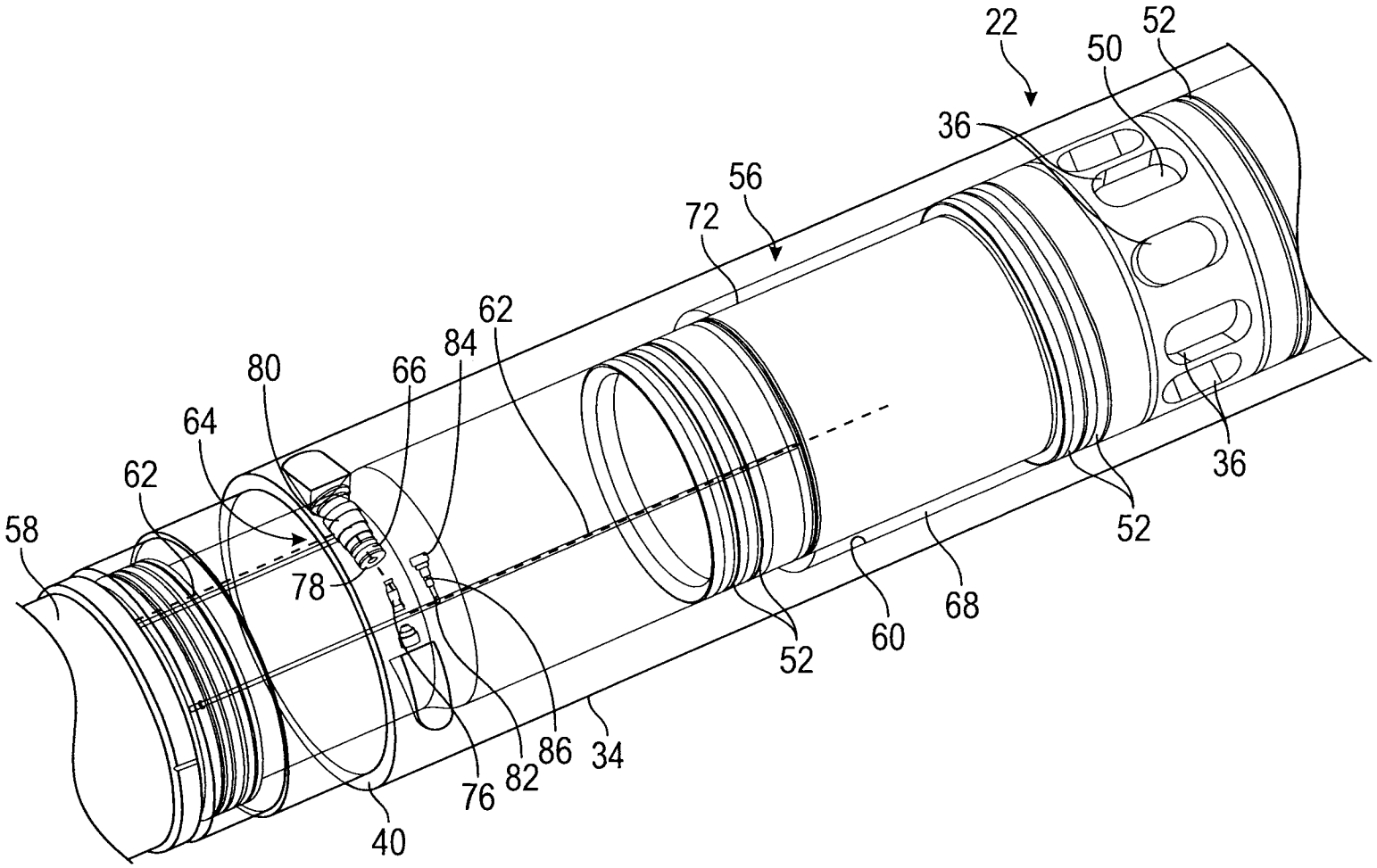
FIG. 3 is an illustration of an example of the toe valve system which shows a chamber system having a passageway able to direct flow of liquid from a piston chamber to an atmospheric chamber, according to an embodiment of the disclosure.

As further illustrated in FIG. 3, the passageway 62 may comprise one or more passageways drilled or otherwise formed through outer housing 34. In the example illustrated in FIG. 3, a flow restrictor 76 is positioned along passageway 62 to restrict the flow, i.e. the flow rate, of liquid 68 as it moves along the passageway 62 following rupture of rupture member 66 (or other type of opening of release member 64). Once passageway 62 is open to flow, the liquid 68 is able to flow at a controlled rate through flow restrictor 76, through the open release member 64, and ultimately into atmospheric chamber 58. In some embodiments, other components may be positioned along passageway 62.

With further reference to FIG. 3, various additional components may be utilized in some embodiments of multicycle valve system 22. Examples of such additional components include a seal plug receptacle 78, configured to receive a seal plug, and a rupture disc retainer 80. In some applications, a suitable seal plug is initially secured in the seal plug receptacle 78 to retain liquid 68 in piston chamber 60 during transport to a field location. This allows an operator to select a suitable rupture disc 66 (having a desired rupture or opening pressure) after the components are shipped to the field location. Once the desired rupture disc 66 is selected, the operator may simply remove the seal plug from the seal plug receptacle 78, insert the desired rupture disc 66, and retain the rupture disc 66 via the rupture disc retainer 80. In some embodiments, the initial filling of piston chamber 60 with liquid 68 may be facilitated via a fill port 82 provided through outer housing 34 and into communication with passageway 62. The fill port 82 may be blocked after filling with a suitable filling port plug 84 having one or more plug seals 86.

In an operational example, the piston chamber 60 may initially be vacuum filled with oil 68 (or another suitable liquid with low compressibility) before the tubing string 26 is run in hole. For example, the piston chamber 60 may be filled by introducing oil 68 through fill port 82 and then subsequently sealing off fill port 82 with filling port plug 84. The trapped oil 68 holds piston sleeve 50 in the closed position covering ports 36; and the tubing string 26 may then be run downhole in this closed position.

Figure 4:
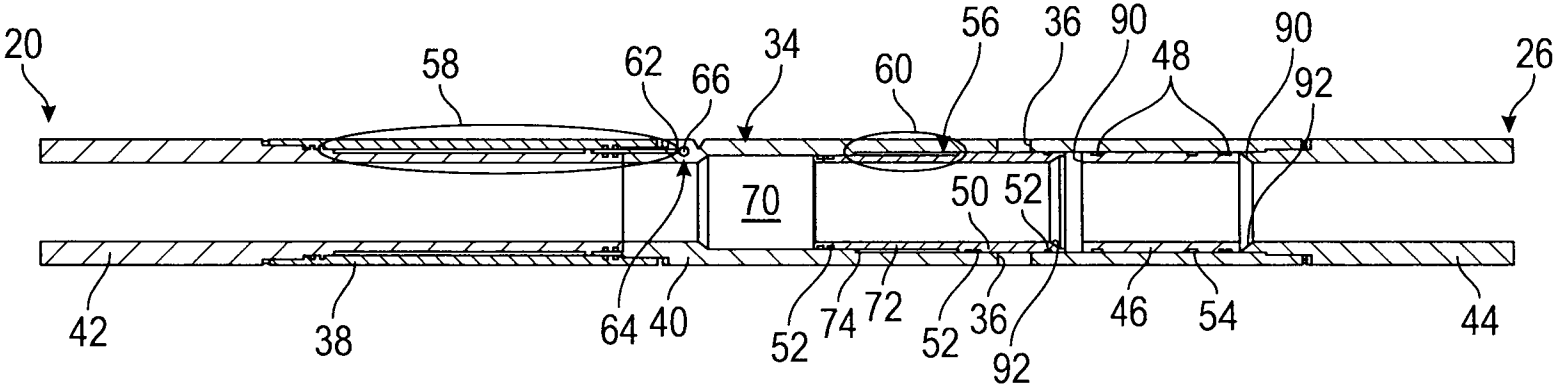
FIG. 4 is a cross-sectional illustration showing utilization of an increased pressure within the tubing string to initiate shifting of a piston sleeve from a closed position to an open position, according to an embodiment of the disclosure.

As the tubing string 26 is run in hole, the hydrostatic pressure along tubing string interior 70 increases, as represented by pressure P in FIG. 4, and this increased pressure pushes the piston sleeve 50 against the confined oil 68 in piston chamber 60. Because the rupturing pressure of rupture disc 66 is higher than the hydrostatic pressure in tubing string 26, the oil 68 compresses until the oil pressure is equal to the hydrostatic pressure. As a result, the piston sleeve 50 remains pressure balanced while being retained in place to prevent the opening of flow ports 36. During this stage of the operation, the shifting sleeve 46 is retained in place via retaining mechanism 54 and also may remain pressure balanced.

Figure 5:
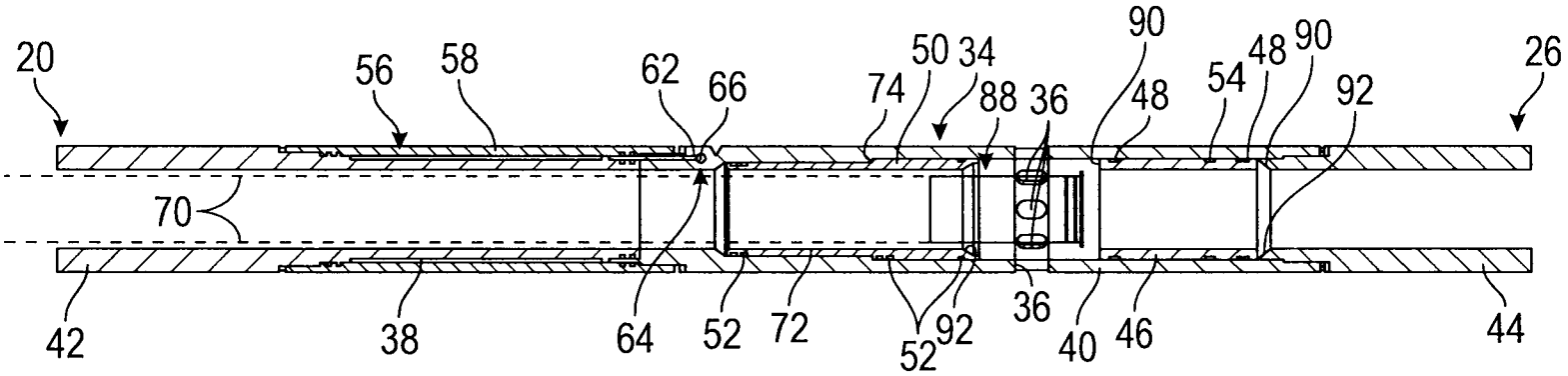
FIG. 5 is a cross-sectional illustration showing use of a shifting tool which may be engaged with a shifting sleeve for movement of the shifting sleeve between operational positions, according to an embodiment of the disclosure.

After the toe valve system 22 is run downhole to a desired location in a deviated, e.g. horizontal, section (or vertical section) of borehole 30, the hydrostatic pressure along the interior of tubing string 26 may be increased. This increased pressure acts on piston sleeve 50 and thus on liquid 68 in piston chamber 60. When the hydrostatic pressure and thus the pressure of liquid 68 is increased sufficiently, the rupture disc 66 is ruptured. The rupture allows pressurized oil 68 in piston chamber 60 to migrate along passageway 62 and into atmospheric chamber 58. As a result, the piston sleeve 50 is in an unbalanced state and shifts along the interior of outer housing 34 until ports 36 are open to allow communication of fluid between the interior and exterior of the tubing string 26, as illustrated in FIG. 5. During this transition, the flow restrictor 76 serves to restrict the flow of oil and thus to protect the wall of piston sleeve 50 from experiencing high differential pressures during the shifting process.

Figure 6:
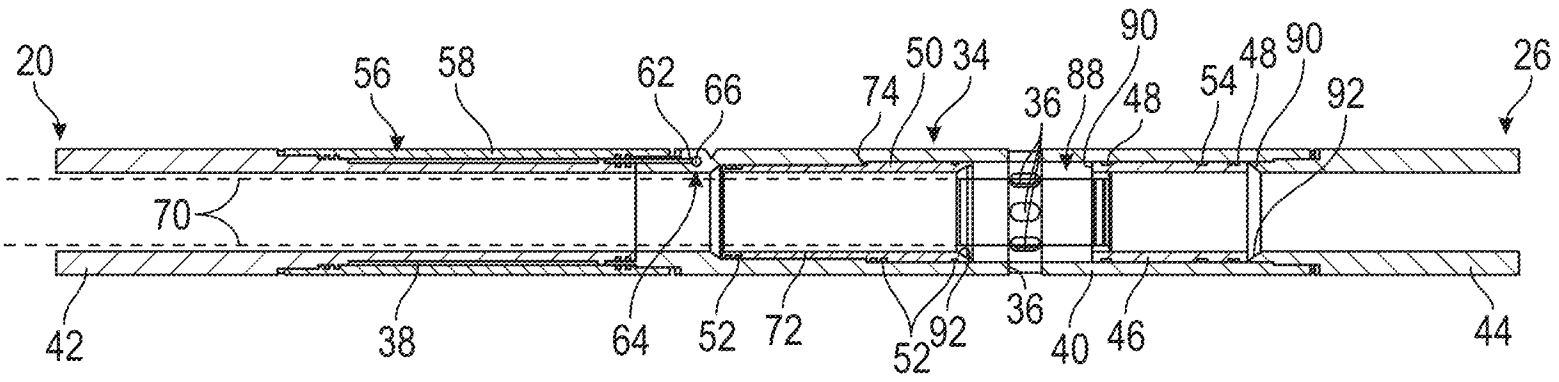
FIG. 6 is a cross-sectional illustration showing use of a shifting tool engaged with a shifting sleeve in an open position, according to an embodiment of the disclosure.
Figure 7:
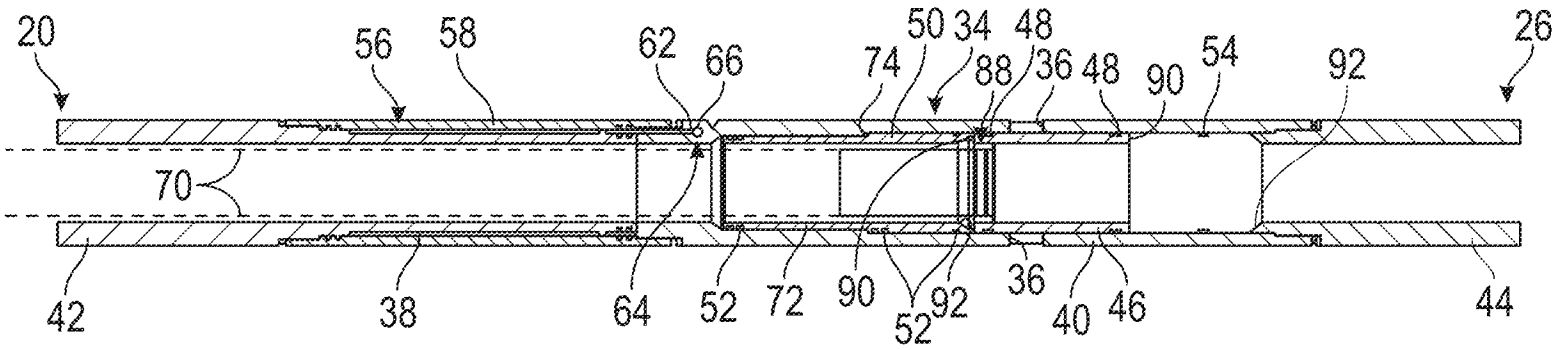
FIG. 7 is a cross-sectional illustration showing use of a shifting tool engaged with a shifting sleeve in a closed position, according to an embodiment of the disclosure.

Once the piston sleeve 50 is shifted to the open position, the shifting sleeve 46 may be shifted between closed positions blocking flow through ports 36 (see FIG. 7) and open positions allowing flow through ports 36 (see FIG. 6) as many times as desired for a given operation. To shift the shifting sleeve 46 between closed and open positions, a shifting tool 88 may be utilized, as illustrated in FIG. 5. By way of example, the shifting sleeve 46 may be constructed with suitable shifting tool profiles 90 configured for engagement with shifting tool 88. In some embodiments, an appropriate shifting tool profile 90 may be located at each longitudinal end of the shifting sleeve 46 to facilitate easy engagement with keys or other shifting elements of shifting tool 88. Suitable engagement with shifting tool 88 enables shifting of the shifting sleeve 46 in either direction along the interior of outer housing 34.

In some embodiments, release profiles 92 may be located along the interior of outer housing 34 to facilitate release of the shifting tool 88 after fully transitioning the shifting sleeve 46 in either direction. For example, release profiles 92 may be positioned along an interior of bottom sub 44 and of piston sleeve 50 as illustrated in FIG. 5. As described above, retaining mechanism 54 may be used to provide resistance to movement of shifting sleeve 46 when shifting sleeve 46 is in a specific position, e.g. an open flow position. However, the resistance to movement provided by retaining mechanism 54 is readily overcome via linear movement of the shifting tool 88.

Accordingly, the toe valve system 22 may be employed in a variety of downhole operations in which the flow ports 36 are opened and closed multiple times. The toe valve system 22 provides a pressure activated multicycle tool via its unique configuration and use of dual sleeves, i.e. shifting sleeve 46 and piston sleeve 50. As described above, various downhole operations involve initially running the toe valve system 22 downhole in a first position, e.g. a closed position, and then shifting the toe valve system to a second position, e.g. an open flow position, via a pressure increase along the interior of the tubing string 26. This pressure increase is above a specified value sufficient to open the release member 64. As a result, liquid 68 is able to flow from piston chamber 60 to atmospheric chamber 58 which, in turn, allows shifting of piston sleeve 50 between operational positions, e.g. from a closed position to an open position. Subsequently, multiple shifts of shifting sleeve 46 between open and closed positions may be performed using a suitable shifting tool, such as a coiled tubing deployed shifting tool.

The structure of toe valve system 22 enables its use in a wide variety of environments, including high pressure, high temperature, and sour environments. Sealing between components, e.g. sealing between the shifting sleeve 46/piston sleeve 50 and the surrounding interior surface of outer housing 34, may be achieved via a variety of sealing technologies and may utilize molded seals, V-packing seals, T-seals, or other types of sealing technologies. Similarly, the shifting sleeve 46 may utilize various types of shifting profiles for use with a variety of shifting tools. Suitable release profiles also may be selected according to the type of shifting tool to enable release of the shifting tool following transition of the shifting sleeve 46 to a desired operational position.

Depending on the parameters of a given downhole operation, the multicycle valve system 22 may be used with casing string 28 or with other types of tubing strings. As described herein, the multicycle valve system 22 may be utilized as a toe valve system; however the multicycle valve system 22 may be utilized in various other types of operations, tubing strings, and locations. Additionally, the multicycle valve system 22 may include components of various sizes, configurations, and materials. For example, the shifting sleeve 46 and the piston sleeve 50 may be constructed in various configurations and may utilize various types of seals. Additionally, the outer housing may be constructed as a single housing or by combining a plurality of outer housings. Control over the outflow of liquid from the piston chamber 60 also may be controlled via various flow restrictors or other types of components to achieve desired transition of the piston sleeve 50. Similarly, the outflowing liquid may be conducted to a variety of atmospheric chambers 58 or other locations which enable the desired shifting of piston sleeve 50.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing string having a toe valve system disposed along the tubing string to control fluid flow between an interior and an exterior of the tubing string positioned in a borehole, the toe valve system comprising:

an outer housing having at least one port to enable fluid flow between the interior and the exterior of the tubing string;

a shifting sleeve slidably mounted within the outer housing, the shifting sleeve biased by a shifting tool for movement between positions opening and closing the at least one port;

a retaining mechanism configured to resist movement of the shifting sleeve from a position in which the shifting sleeve leaves the at least one port open, the shifting tool configured to bias the shifting sleeve to overcome resistance of the retaining mechanism;

a piston sleeve slidably mounted within the outer housing for movement between positions closing and opening the at least one port; and a chamber system having an atmospheric chamber connected with a piston chamber via a passageway initially blocked by a rupture member, the piston chamber initially containing a liquid and being located between the piston sleeve and the outer housing to provide a pressure balance between an interior and an exterior of the piston sleeve while the piston sleeve is in a position closing the at least one port, wherein sufficient application of pressure within the tubing string and against the piston sleeve causes the rupture member to rupture and to thus allow flow of the liquid from the piston chamber to the atmospheric chamber as the piston sleeve is shifted to a position opening the at least one port, wherein the outer housing includes an outer housing release profile configured to facilitate release of the shifting tool from the shifting sleeve beyond a predetermined position in a first direction.

2. The system as recited in claim 1, wherein the chamber system further comprises a flow restrictor to restrict flow of the liquid along the passageway following rupture of the rupture member.

3. The system as recited in claim 1, wherein the rupture member comprises a rupture disc.

4. The system as recited in claim 1, wherein the liquid comprises an oil.

5. The system as recited in claim 4, wherein the piston chamber is filled with the oil through a fill port extending through the outer housing.

6. The system as recited in claim 1, wherein the outer housing comprises a plurality of outer housings.

7. The system as recited in claim 1, wherein the at least one port comprises a plurality of ports oriented to enable radial flow through the outer housing, the plurality of ports being arranged along a circumference of the outer housing.

8. The system as recited in claim 1, wherein the piston sleeve has a thinner wall section relative to the remainder of the piston sleeve, the thinner wall section being adjacent the piston chamber.

9. The system as recited in claim 1, wherein the atmospheric chamber is located between a portion of the outer housing and an upper sub.

10. The system as recited in claim 1, wherein the tubing string comprises a casing string.

11. A system, comprising:

a multicycle valve system for use along a well string, the multicycle valve system comprising a shifting sleeve and a piston sleeve slidably disposed in an outer housing having at least one radial port therethrough, the piston sleeve initially being held in a position closing the at least one radial port via liquid trapped in a piston chamber which is located between the piston sleeve and the outer housing, the liquid being retained in the piston chamber by a release member until sufficient pressure is applied within the multicycle valve system and against the piston sleeve such that the piston sleeve is shifted to a position opening the at least one radial port;

a retaining mechanism configured to resist movement of the shifting sleeve from a position in which the shifting sleeve leaves the at least one radial port open; and a shifting tool configured to bias the shifting sleeve to overcome resistance of the retaining mechanism for movement of the shifting sleeve, wherein the outer housing includes an outer housing release profile configured to facilitate release of the shifting tool from the shifting sleeve beyond a predetermined position in a first direction.

12. The system as recited in claim 11, wherein the multicycle valve system further comprises an atmospheric chamber into which the liquid drains once the release member is actuated to release a flow of liquid from the piston chamber.

13. The system as recited in claim 12, wherein the liquid comprises oil.

14. The system as recited in claim 13, wherein the release member is positioned along a passageway between the piston chamber and the atmospheric chamber.

15. The system as recited in claim 14, wherein the release member is a rupture disc.

16. The system as recited in claim 15, wherein a flow restrictor is positioned along the passageway to restrict flow along the passageway following rupture of the rupture disc.

17. The system as recited in claim 11, wherein the at least one radial port comprises a plurality of ports oriented to enable radial flow through the outer housing, the plurality of ports being arranged along a circumference of the outer housing.

18. A method, comprising:

positioning a toe valve system along a tubing string to enable fluid communication between an interior and an exterior of the tubing string via at least one port;

closing off the at least one port with a piston sleeve;

using a liquid temporarily trapped in a piston chamber to secure the piston sleeve at the position closing off the at least one port while also pressure balancing a piston between the interior of the tubing string and the piston chamber;

selectively releasing the liquid to enable shifting of the piston sleeve to a position allowing flow through the at least one port; and operating a shifting tool to overcome resistance of a retaining mechanism to move a shifting sleeve in a first direction to a position closing the at least one port, movement of the shifting tool beyond a first predetermined position in the first direction causing a piston sleeve release profile to release the shifting tool from the shifting sleeve.

19. The method as recited in claim 18, wherein selectively releasing comprises increasing pressure in an interior of the tubing string until the piston sleeve causes the liquid to rupture a rupture disc and to flow into an atmospheric chamber.

20. The method as recited in claim 18, further comprising operating the shifting tool to move the shifting sleeve in a second direction to a position opening the at least one port, movement of the shifting tool beyond a second predetermined position in the second direction causing an outer housing release profile to release the shifting tool from the shifting sleeve.

* * * * *